United States Patent [19]

Franklin, Jr.

[11] 4,299,429

[45] Nov. 10, 1981

[54] COOLER WITH INCLINED UPPER $CO_2$ COOLED SURFACE

[76] Inventor: Paul R. Franklin, Jr., 5211 W. Beaver St., Jacksonville, Fla. 32205

[21] Appl. No.: 121,303

[22] Filed: Feb. 13, 1980

[51] Int. Cl.[3] ..... A47B 77/08; F25D 3/12

[52] U.S. Cl. ..... 312/236; 312/214; 62/384; 62/388

[58] Field of Search ..... 312/214, 236; 62/384, 62/385, 388

[56] References Cited

U.S. PATENT DOCUMENTS

| | | | |
|---|---|---|---|
| 3,695,056 | 10/1972 | Glynn et al. | 62/384 |
| 3,864,936 | 2/1975 | Frank et al. | 62/384 |
| 3,922,878 | 12/1975 | Karchay | 62/388 |
| 3,992,069 | 11/1976 | Kitterman | 312/236 |

*Primary Examiner*—Victor N. Sakran
*Attorney, Agent, or Firm*—Harvey B. Jacobson

[57] ABSTRACT

A cabinet is provided for containing items to be maintained in a cooled state and includes a hollow insulated housing having upstanding side walls and top and bottom walls closing the upper and lower ends of the housing. An inclined baffle is mounted within an upper portion of the housing and is constructed of a material having good heat transfer properties. The baffle defines a first closed heat absorbent material receiving chamber thereabove and a second cooled items receiving chamber therebelow within the housing. The lower marginal portion of the baffle terminates substantially against the inner surface of one side wall of the housing and the cabinet includes first and second access means opening into the interior of the first and second chambers from the exterior of the cabinet.

9 Claims, 6 Drawing Figures

COOLER WITH INCLINED UPPER $CO_2$ COOLED SURFACE

BACKGROUND OF THE INVENTION

Many different forms of cabinets heretofore have been provided for containing items to be maintained in a cooled state and some of these cabinets include separate compartments therein maintained out of direct communication through the utilization of a partition wall or baffle portion constructed of a material having good heat transfer properties. With such construction, items to be maintained in a cooled state may be stored in one of the compartments and an appropriate heat absorbent material may be stored within the other compartment. Such cabinets are conventionally utilized to contain ice cream and other frozen confections as well as other materials.

Conventional ice boxes were in the past constructed in a similar manner enabling ice to be contained within one compartment and food chilled to be contained in the other compartment. However, ice boxes were and are inefficient for maintaining food in a frozen state, even when a heat absorbing material of considerably lower temperature than 32° F. is used in lieu of ice.

Accordingly, a need exists for a cabinet which may be utilized to transport and store foodstuffs to be maintained in a frozen state independent of a refrigeration unit being operatively associated with the cabinet.

BRIEF DESCRIPTION OF THE INVENTION

The cooler of the instant invention is in the form of an upright cabinet, although it may be constructed in the form of a lower height chest-type structure, and the interior of the upper portion of the cabinet includes an inclined baffle constructed of a material having good heat transfer properties. A first closed heat absorbent material receiving chamber is defined within the cabinet above the baffle and a second cooled items receiving chamber is defined within the cabinet below the baffle. The baffle, preferably, extends substantially the entire transverse dimension of the cabinet interior extending from the upper marginal edge of the baffle to the lower marginal edge thereof and the atmosphere within the cooled items receiving chamber of the cabinet is cooled by contact with the undersurface of the inclined baffle and flows downwardly along the undersurface of the baffle to set up and maintain convection currents within the cabinet in order to insure reasonable velocity air circulation therein without the use of air circulating fans, or the like.

Although some cabinet coolers of this type heretofore have been constructed within an inclined baffle, but instead have included a vertical baffle wall on one side of which a heat absorbent material may be received and on the other side of which items to be maintained chilled are received, this type of construction, utilizing a full vertical height chilled baffle is not as effective in setting up and maintaining convection currents of air within the cooled items receiving chamber, inasmuch as the single chilled vertical baffle tends to cause downward movement along only one wall of the interior of the cooled items receiving chamber and does not also function to create a flow of air in a generally horizontal direction toward the top of that vertical baffle. As a result, conventional cooling cabinet construction functions in a manner allowing warmer air to accumulate in the upper portion of the cabinet and colder air to accumulate in the lower portion of the cabinet, particularly when the supply of heat absorbent material is depleted to the extent that only the lower two-thirds, or less, of the vertical baffle is cooled by direct contact with the heat absorbent material.

The main object of this invention is to provide a cooler in which items to be maintained in a cooled state may be received and with the cooler constructed in a manner such that the temperaure of the items received therein may be actually lowered and maintained more evenly cooled throughout the operational period of the heat absorbent material within the cabinet.

Another object of the present invention is to provide a cooler in accordance with the preceding object and which may be used as a portable cooler with the cabinet being initially charged and filled with items to be maintained cooled and then placed upon a vehicle, such as a truck, or the like, and transported to a remote location while the materials within the cabinet are maintained in a cooled state and even further cooled during transit.

Yet another object of this invention is to provide a cooler constructed in a manner whereby items to be maintained cooled may be readily removed therefrom and packed thereinto and which will also enable the heat absorbent material chamber of the cabinet to be readily charged.

A final object of this invention to be specifically enumerated herein is to provide a cooler in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
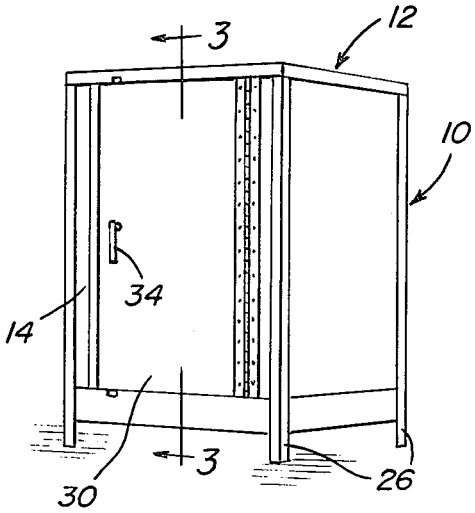
FIG. 1 is a perspective view of the cooler of the instant invention as seen from the front side thereof.
Figure 2:
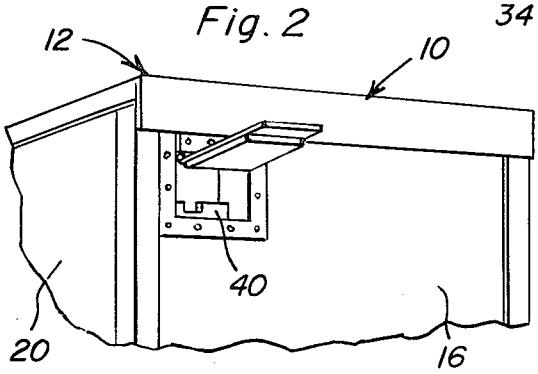
FIG. 2 is a fragmentary rear perspective view of the cooler illustrating the access door for charging the $CO_2$ compartment of the cooler.
Figure 3:
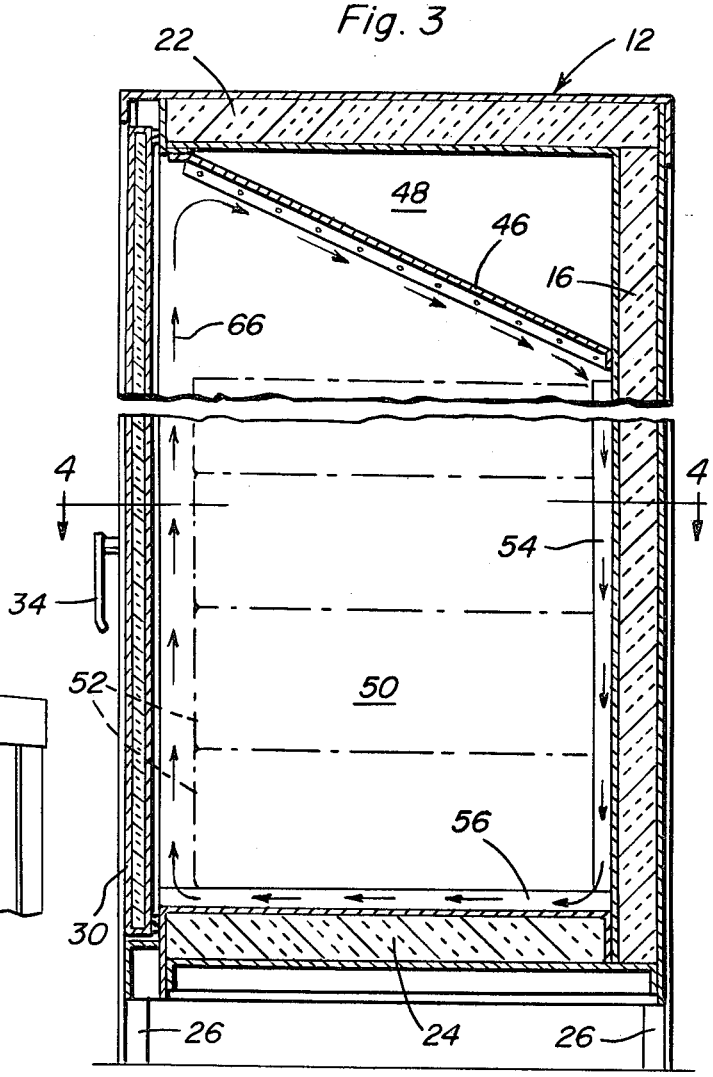
FIG. 3 is an enlarged fragmentary vertical sectional view taken substantially upon the plane indicated by the section line 3—3 of FIG. 1.

Referring now more specifically to the drawings, the numeral 10 generally designates a cooler constructed in accordance with the present invention. The cooler 10 includes an upright housing 12 having front and rear walls 14 and 16, opposite side walls 18 and 20 and top and bottom walls 22 and 24 The lower end of the housing 12 includes four corner legs 26 which project downwardly below the bottom wall 24 and the front wall 14 has an access opening 28 formed therein with which a hinged access door 30 is operatively associated for opening and closing the access opening 28.

The walls 14, 16, 18, 20, 22 and 24 are all heavily insulated and the door 30 is also insulated. In addition, suitable seal structure 32 is provided on the door 30 for maintaining an airtight seal and the door 30 includes latching structure incorporating an operating handle 34 by which the door 30 may be releasably secured in the closed position.

The rear wall 16 includes an access opening 36 therein provided with a hinged closure door 38 and the closure door 38 includes magnetic structure for maintaining the door 38 in a closed position. The door 38 also be insulated and provided with seal structure.

Figure 5:
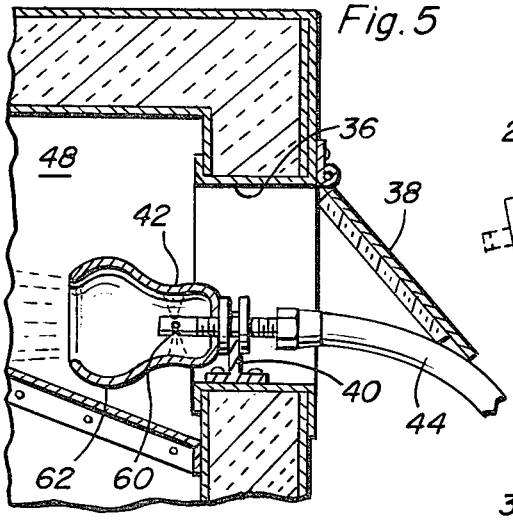
FIG. 5 is a fragmentary vertical sectional view illustrating the manner in which the $CO_2$ compartment of the cooler may be charged with $CO_2$ snow.
Figure 4:
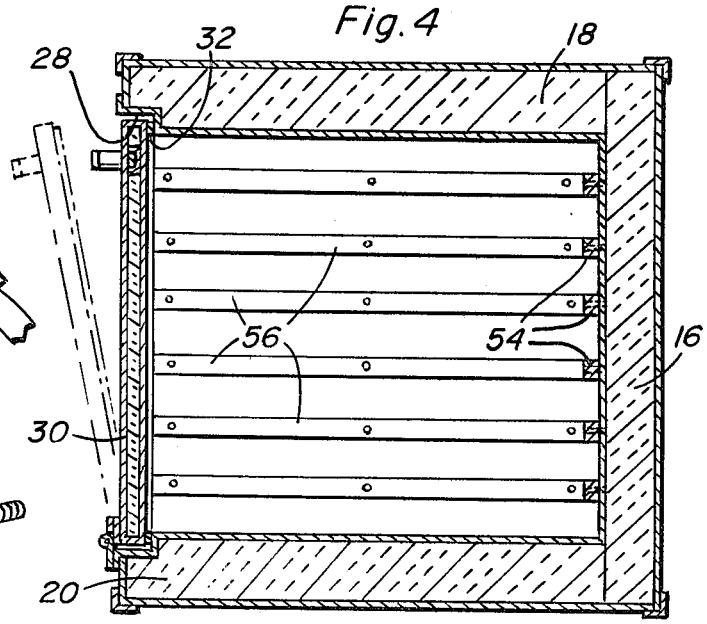
FIG. 4 is a horizontal sectional view taken substantially upon the plane indicated by section line 4—4 of FIG. 3.
Figure 6:
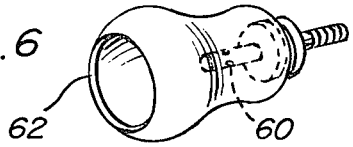
FIG. 6 is a perspective view of the snow producing nozzle for the liquid $CO_2$ line to be used in charging the cooler.

The access opening 36 has a notched support bracket 40 mounted therein inwardly of the door 38 and the snow forming nozzle structure 42 of a liquid $CO_2$ supply line 44 may be supported from the bracket 40 with the nozzle structure 42 projecting into the interior of the housing 12 in the manner illustrated in FIG. 5.

The interior of the housing 12 includes an inclined baffle 46 mounted therein and dividing the interior of the housing 12 into an upper heat absorbent material receiving chamber 48 into which the access opening 36 opens and a lower items receiving chamber 50 in which items 52 to be maintained cooled may be received. The baffle is inclined 30°, but may be inclined between 25° and 40°. By placing the baffle in an inclined position, it is assured that the $CO_2$ snow within chamber 48 remains in contact with the baffle and the air cooled by the baffle 46 may move by gravity downwardly therealong and along the inner surface of the rear wall 16. If an angle greater than 40° is used, the volume of the chamber 48 loss in volume of chamber 50 becomes too great and an angle of less than 25° allows the chilled air to fall substantially vertically away from the baffle rather than move downwardly therealong in a path generally paralleling the baffle 46.

The inner surface of the rear wall 16 below the baffle 46 includes transversely spaced vertical load spacing bars or members 54 supported therefrom and the inner surface of the bottom wall 24 includes similar transversely spaced front-to-rear extending load spacing bars or members 56. The bars 54 and 56 maintain the items 52 out of direct contact with the inner surface of the rear wall 16 and the inner surface of the bottom wall 24.

In operation, the items 52 to be maintained cooled may be received within the compartment 50 either before or after the heat absorbent material receiving chamber or compartment 48 is charged. However, in order to charge the chamber 48, the door 38 is opened and the nozzle structure 42 is supported from the support bracket 40 in the manner illustrated in FIG. 5 of the drawings and liquid $CO_2$ is supplied to the nozzle structure 42 through the supply line 44. The liquid $CO_2$ is discharged through the four lateral discharge openings 60 formed in the nozzle and strikes the inner surface of the bell portion 62 of the nozzle structure 42 in order to be transformed into $CO_2$ snow. The $CO_2$ snow substantially fills the compartment 48 and after the compartment 48 has been filled with $CO_2$ snow the nozzle structure 42 is removed and the door 38 is swung to its closed position and magnetically maintained in its closed position. The atmosphere (air) within the compartment 50 and contacting the lower surface of the chilled baffle 46 moves downwardly along the baffle 46 toward the rear wall 16 and then downwardly along the inner surface of the rear wall 16 between the spacing bars 54. Of course, the chilled air then flows forwardly from the lower end of the wall 16 across the upper surface of the bottom wall 24 between the spacing bars 56. This, of course, results in a convection current being set up within the compartment 50 in the form of air circulation 66. As the warmer air within the compartment rises along inner surface of the door 30 and reaches the upper portion of the compartment 50, it contacts the cooled undersurface of the baffle 46 and is chilled and therefore falls, by gravity, downwardly along the underside of the baffle 46 and thereafter downwardly along the inner surface of the rear wall 16. The baffle 46 is constructed of a material having good heat transfer properties and it has been found that the items 52, because of the convection current 66, may be chilled even further. Also, inasmuch as the chilled air comprising the convection current 66 moves at greater than minimal speed, the entire block of items 52 within the compartment 50 is maintained at an even temperature.

Although the utilization of the baffle 46 in the upper portion of the interior of the housing 12 results in a small percentage of the interior of the housing 12 being lost for receiving the items 52, the loss of internal volume within the compartment 50 is maintained at a minimum and, in fact, is considerably less than the loss of volume that would occur if a vertical baffle spaced inward of the rear wall 16 was used in lieu of the inclined baffle 46. Additionally, if such a vertical baffle was used after initial depletion of some of the $CO_2$ snow behind the baffle had occurred, the snow would not be in direct contact with the vertical baffle and the cooling capacity would be severely limited. Also, the convection current 66 would not be present.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A cabinet for containing items to be maintained in a cooled state, said cabinet including a hollow insulated housing having pairs of upstanding side walls and top and bottom walls closing the upper and lower ends of said housing, an inclined baffle mounted within the upper portion of said housing, said inclined baffle being constructed of a material having good heat transfer properties and defining a first closed heat absorbent material receiving chamber thereabove and a second cooled item receiving chamber therebelow within said housing, the lower marginal portion of said baffle terminating substantially against the inner surface of one side wall of said housing, said cabinet including first access means opening into the interior of the first chamber from the exterior of the cabinet and second access means opening into the second items receiving chamber from the exterior of the cabinet, the bottom wall of said housing including upwardly projecting spacer members upon which to support a load of cooled items on said bottom wall, said spacer members being shaped to form, in combination with said load, convection air flow passages between the underside of said load and said bottom wall extending between the lower portion of said one side wall and the lower portion of the side wall opposite said one side wall, said one side wall also including spacer members projecting outwardly therefrom toward the opposite side wall to form, in conjunction with the opposing side of said load, convection airflow passages extending between the lower marginal edge of said baffle and said bottom wall.

2. The combination of claim 1 wherein said baffle is inclined between 25° and 40° relative to the horizontal.

3. The combination of claim 1 wherein said second access means comprises an opening formed in the side wall of said housing opposite said one side wall, and a closure door for said opening movable into and out of position closing said opening.

4. The combination of claim 3 wherein the upper marginal edge of said baffle is spaced closely adjacent the upper marginal edge of said opening.

5. The combination of claim 1 wherein said first access means includes an opening formed in an upper portion of said one side wall above the lower marginal edge of said baffle and a door movable into and out of closing relation with said opening.

6. A cabinet for containing items to be maintained in a cooled state, said cabinet including a hollow insulated housing having upstanding side walls and top and bottom walls closing the upper and lower ends of said housing, an inclined baffle mounted within the upper portion of said housing, said inclined baffle being constructed of a material having good heat transfer properties and defining a first closed heat absorbent material receiving chamber thereabove and a second cooled items receiving chamber therebelow within said housing, the lower marginal portion of said baffle terminating substantially against the inner surface of one side wall of said housing, said cabinet including first access means opening into the interior of the first chamber from the exterior of the cabinet and second access means opening into the second items receiving chamber from the exterior of the cabinet, said first access means including an opening formed in an upper portion of said one side wall above the lower marginal edge of said baffle and a door movable into and out of closing relation with said opening, said door including a first marginal edge portion thereof hingedly supported from said housing and a second free marginal edge thereof remote from said one marginal edge equipped with magnetic means for magnetically maintaining said door in a closed position whereby a build-up of gas pressure within said first chamber may be vented therefrom to the exterior of said cabinet.

7. The combination of claim 6 wherein said baffle is inclined between 25° and 40° relative to the horizontal.

8. The combination of claim 7 wherein said second access means comprises an opening formed in the side wall of said housing remote from said one side wall, and a closure door for the last mentioned opening movable into and out of position closing the latter.

9. The combination of claim 8 wherein the upper marginal edge of said baffle is spaced closely adjacent the upper marginal edge of the last mentioned opening.

* * * * *